US008740585B2

(12) United States Patent
Park et al.

(10) Patent No.: US 8,740,585 B2
(45) Date of Patent: Jun. 3, 2014

(54) HERMETIC COMPRESSOR

(75) Inventors: Kyoungjun Park, Seoul (KR); Kyeongho Kim, Seoul (KR); Jongmok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 139 days.

(21) Appl. No.: 13/280,544

(22) Filed: Oct. 25, 2011

(65) Prior Publication Data

US 2012/0100020 A1 Apr. 26, 2012

(30) Foreign Application Priority Data

Oct. 26, 2010 (KR) ..... 10-2010-0104758

(51) Int. Cl.
*F04B 17/03* (2006.01)
*F04B 39/02* (2006.01)
*F04B 53/18* (2006.01)

(52) U.S. Cl.
CPC ..... *F04B 39/023* (2013.01); *F04B 39/0253* (2013.01)
USPC ..... 417/415

(58) Field of Classification Search
CPC ..... F04B 39/0246; F04B 39/0238; F04B 39/0253; F04B 53/18
USPC ..... 417/415, 902; 92/157
See application file for complete search history.

(56) References Cited

U.S. PATENT DOCUMENTS

| | | | | | |
|---|---|---|---|---|---|
| 2,059,894 | A | * | 11/1936 | Newman | 417/281 |
| 2,628,765 | A | * | 2/1953 | Anderson | 417/419 |
| 4,518,324 | A | * | 5/1985 | Mizuno et al. | 417/366 |
| 2007/0081908 | A1 | * | 4/2007 | Nishihara | 417/415 |

FOREIGN PATENT DOCUMENTS

| | | | |
|---|---|---|---|
| CN | 1878960 | A | 12/2006 |
| CN | 101657639 | A | 2/2010 |
| GB | 2 025 530 | A | 1/1980 |
| JP | 55 148994 | A | 11/1980 |

OTHER PUBLICATIONS

Chinese Office Action dated Dec. 4, 2013 for corresponding Application No. 201110333738.6.

* cited by examiner

*Primary Examiner* — Bryan Lettman
(74) *Attorney, Agent, or Firm* — Ked & Associates LLP

(57) ABSTRACT

A hermetic compressor is provided that is capable of supplying oil even in a low-speed operation. The hermetic compressor includes a hermetic container filled with oil in a base thereof, a rotatably crank shaft having a screw-shaped oil groove in an outer portion thereof, and an oil feeder having an upper portion in which a lower portion of the crank shaft is inserted, the oil feeder having a lower portion immersed in the oil of the hermetic container.

17 Claims, 3 Drawing Sheets

HERMETIC COMPRESSOR

This application claims the benefit of priority of Korean Patent Application No. 10-2010-0104758 filed on Oct. 26, 2010, which is incorporated by reference in their entirety herein.

BACKGROUND OF THE INVENTION

1. Field of the Invention

The present invention relates to a hermetic compressor, and more particularly, to a hermetic compressor capable of supplying oil even during a low-speed operation.

2. Related Art

A general hermetic compressor includes a motor part provided in a hermetic container and generating power, and a compression part operating upon receiving power from the motor part. The hermetic compressor may be classified into reciprocating, rotary, vane, and scroll types, etc. according to a method of compressing a refrigerant, which is a compressible fluid.

In the hermetic compressor, a crank shaft coupled to a rotor of the motor part transfers power while rotating together with the rotor, and an interlocking member coupled to the crank shaft receives power from the motor part and forms a compression chamber to compress refrigerants.

A lower part of the hermetic container of the hermetic compressor is filled with oil, an oil path is formed in an axial direction of the crank shaft, and an oil feeder is installed at a lower end of the oil path so as to be immersed in oil. As the crank shaft rotates, oil is pumped along the oil path to be fed. In such a structure, oil feeding needs to be smoothly made even during a low-speed operation in which the crank shaft rotates slowly.

SUMMARY OF THE INVENTION

It is, therefore, an object of the present invention to provide a hermetic compressor capable of feeding oil even during a low-speed operation.

It is another object of the present invention to provide a hermetic compressor capable of pumping oil without leaking it.

Objects of the present invention are not limited to the aforementioned objects, and objects other than mentioned ones would be clearly understood by those skilled in the art from the following disclosure.

To realize the objects, the hermetic compressor according to an exemplary embodiment of the present invention includes a hermetic container filled with oil in a base thereof, a rotatable crank shaft having a screw-shaped oil groove in an outer portion thereof, and an oil feeder having an upper portion in which a lower portion of the crank shaft is inserted, the oil feeder having a lower portion immersed in oil of the hermetic container.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE EMBODIMENTS

Figure 1:
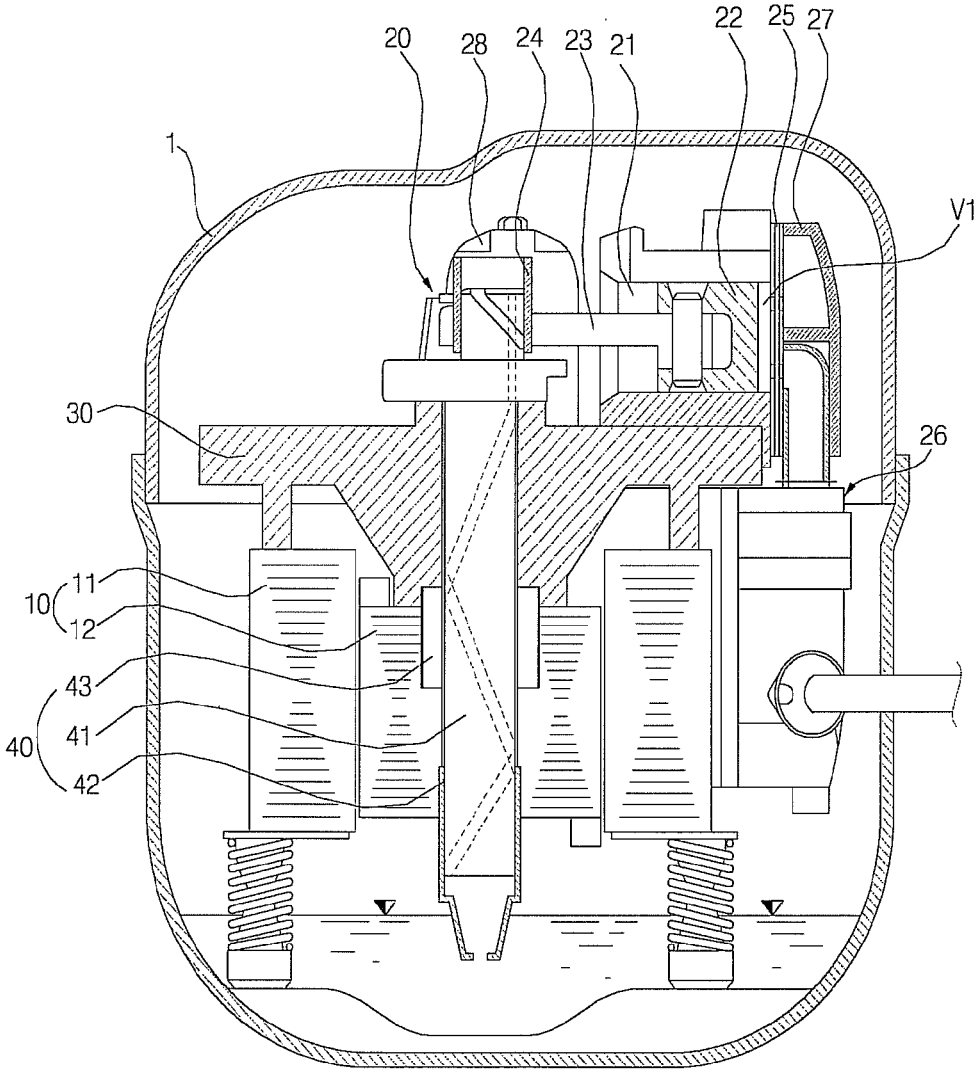
FIG. 1 is a cross-sectional view illustrating a hermetic compressor according to an exemplary embodiment of the present invention.

Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. Like reference numerals refer to like elements throughout.

Hereinafter, a hermetic compressor according to embodiments of the present invention will be described with reference to the accompanying drawings.

Figure 2:
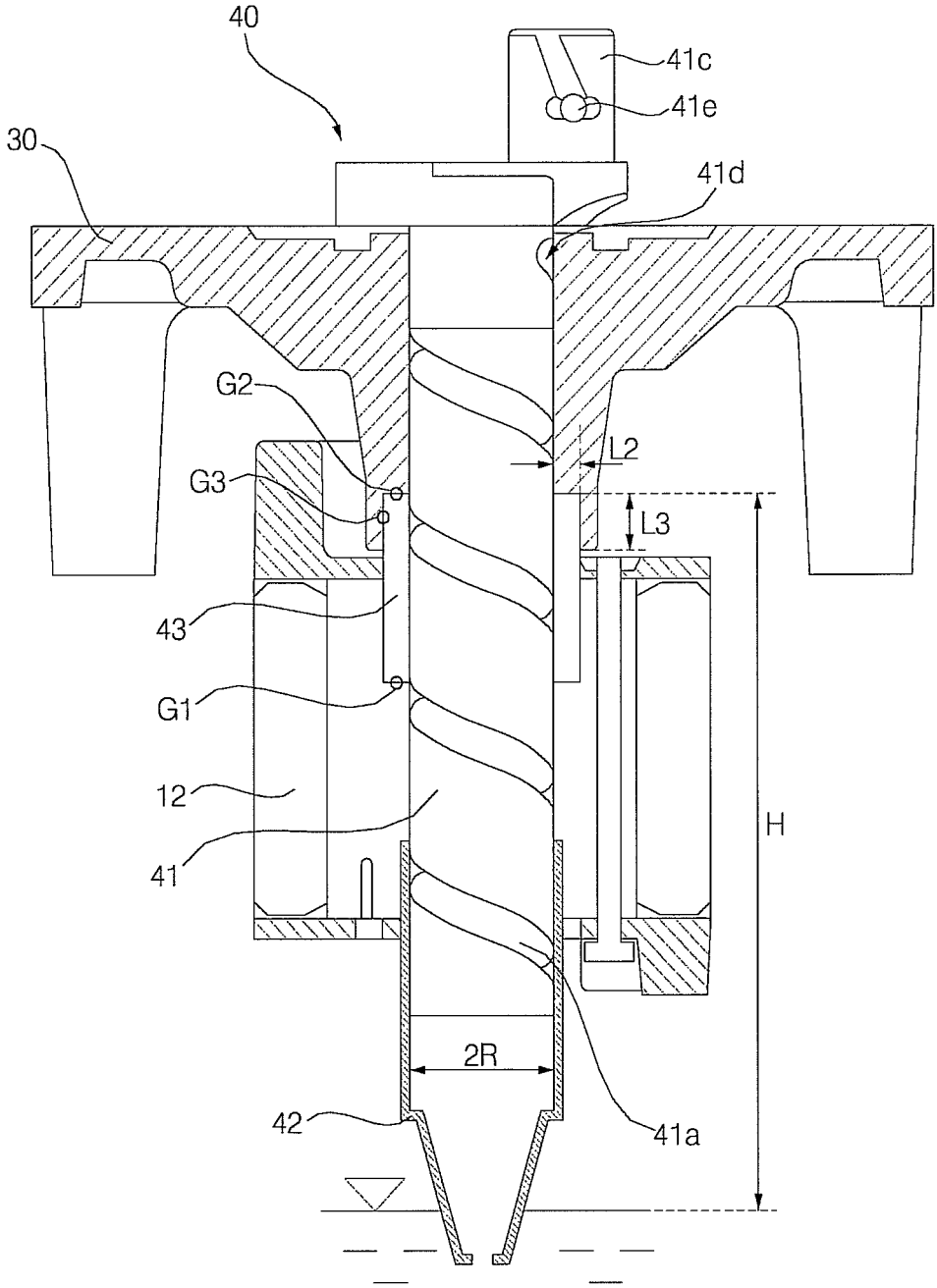
FIG. 2 is a view illustrating a structure of part of a hermetic compressor according to an exemplary embodiment of the present invention.

FIG. 1 is a cross-sectional view illustrating a hermetic compressor according to an exemplary embodiment of the present invention, and FIG. 2 is a view showing a structure of part of a hermetic compressor according to an exemplary embodiment of the present invention.

A hermetic compressor according to an exemplary embodiment of the present invention includes a hermetic container 1 filled with oil in its base, a rotatable crank shaft 41 having a screw-shaped oil groove 41*a* in its outer portion, an oil feeder 42 having an upper portion in which a lower portion of the crank shaft 41 is inserted and having a lower portion immersed in the oil filled in the hermetic container 1, a motor 10 provided on the circumference of the crank shaft 41 and rotating the crank shaft 41, and a compression part 20 compressing a refrigerant upon receiving a rotary force of the crank shaft 41.

A crank shaft pin part 41*c* is formed at an upper portion of the crank shaft 41. A sleeve 24 is coupled to the crank shaft pin part 41*c* in order to reciprocate a piston 22. A lower portion of the crank shaft 41 is inserted in the oil feeder 42.

The crank shaft 41 has the screw-shaped oil groove 41*a* on its outer portion. As the crank shaft 41 is rotated by the motor 10, oil is pumped along the oil groove 41*a*. When the crank shaft 41 is rotated, oil flows upward by a centrifugal force up to the upper end H of the bushing 43, and flows upward again by a viscous force from above the upper end H of the bushing 43.

A first oil hole 41*d* is formed at the upper end of the oil groove 41*a*, and a second oil hole 41*e* where oil induced to the first oil hole 41*d* is discharged and dispersed is formed in the crank shaft pin part 41*c*. A portion of the scattered oil is supplied to the compression part 20, while the other portion thereof is supplied between a frame 30 and the crank shaft 41 in order to lubricate.

The oil feeder 42 has a hollow shape having an upper portion in which the lower portion of the crank shaft 41 is inserted. That is, the oil feeder 42 is coupled to the crank shaft 41 such that its upper portion surrounds the circumference of the lower portion of the crank shaft 41. The lower portion of the oil feeder 42 is immersed in the oil filled in the hermetic container, and has at its lower end a hole through which the oil is introduced.

When the crank shaft 41 rotates, the oil feeder 42 is rotated so that oil induced to the oil feeder 42 rises by a centrifugal force. In a low-speed operation in which the crank shaft 41 rotates slowly, the greater the diameter of oil introduced into the oil feeder 42, the higher oil can flow. Thus, the oil feeder 42 may be coupled to surround the circumference of the crank shaft 41 so as to maximize the diameter of oil introduced into the oil feeder 42. In this case, the diameter 2R of the crank shaft 41 becomes the diameter of oil introduced into the oil feeder 42.

The frame 30 is provided between the compression part 20 and the motor 10. The frame 30 has an opening at its central portion such that the crank shaft 41 passes therethrough. The frame 30 serves as a sliding coupling bearing so that the crank shaft 41 can rotate. According to embodiments, a rolling bearing may be provided between the frame 30 and the crank shaft 41. A cylinder 21 is provided at a portion of the upper side of the frame 30.

The lower portion of the frame 30 is bent so as to allow for the rotation of the upper portion of the bushing 43. The bent part of the lower portion of the frame 30 serves as a sliding coupling bearing so as to allow for the rotation of the bushing 43.

The motor 10 includes a stator 11 supported on the frame 30 and elastically installed inside the hermetic container 1, and a rotor 12 rotating by electromagnetic interaction with the stator 11.

The rotor 12 is fixedly coupled to the crank shaft 41 so as to rotate the crank shaft 41. The rotor 12 is provided at a lower side of the frame 30. The crank shaft 41 passes through the center of the rotor 12 to be fixedly coupled thereto.

The upper portion of the rotor 12 is bent such that the lower portion of the bushing 43 is coupled thereto. The lower portion of the bushing 43 is press-fitted into the bent part of the rotor 12 at its upper portion.

The bushing 43 is fixed to the circumference of the crank shaft 41 between the frame 30 and the rotor 12. The upper portion of the bushing 43 is coupled between the lower portion of the frame 30 and the crank shaft 41, and the lower portion of the bushing 43 is coupled between the upper portion of the rotor 12 and the crank shaft 41.

The bushing 43 has a hollow cylindrical shape, and is fixedly coupled to the crank shaft 41 penetrating the center thereof. The bushing 43 is press-fitted to the rotor 12 to be coupled thereto. The bushing 43 serves as a sliding coupling bearing so as to allow for rotation with the frame 30.

Since the bushing 43 is fixedly coupled to the rotor 12 and the crank shaft 41, the bushing 43 rotates together with the crank shaft 41 when the rotor 12 rotates. When the bushing 43 and the crank shaft 41 rotate, oil induced to the oil feeder 42 flows upward to the upper end H of the bushing 43 by the centrifugal force.

Since the frame 30 does not rotate and only the crank shaft 41 rotates above the upper end of the bushing 43, oil having flowed up to the upper end H of the bushing 43 rises further along the oil groove 41*a* up to the first oil hole 41*d* of the crank shaft 41 by the viscous force.

The bushing 43 prevents the oil having ascended by the centrifugal force from leaking between the crank shaft 41 and the frame 30. The bushing 43 is press-fitted to the rotor 12 so as to prevent oil leakage between the bushing 43 and the rotor 12. The bushing 43 is coupled to the rotor 12 in such a manner as to create a minimum gap allowing for rotation, thus preventing the leakage of oil.

Referring to FIG. 2, a height gap G1 between the lower surface of the bushing 3 and the rotor 12 may be 0 mm so as to not exist. A height gap G2 between the upper surface of the bushing 43 and the frame 30 may range from 0.2 mm to 0.5 mm, and a radial gap G3 between the circumferential surface of the bushing 43 and the frame 30 may range from 0 mm to 0.05 mm.

Furthermore, the radial thickness L2 of the bushing 43 may range from 0.5 mm to 3 mm, and the height L3 of a portion where the frame 30 and the bushing 43 rotatably coupled may range from 1 mm to 10 mm.

The compression part 20 includes a cylinder 21 forming a predetermined compression space V1, a piston 22 compressing a refrigerant while reciprocating in a radial direction inside the compression space V1 of the cylinder 21, a connecting rod 23 having one end rotatably coupled to the piston 22 and the other end rotatably coupled to the crank shaft pin part 41*c* of the crank shaft 41 and converting a rotary motion into a linear motion of the piston 22, a sleeve 24 inserted between the crank shaft pin part 41*c* of the crank shaft 41 and the connecting rod 23 and serving as a friction reducing member, a valve assembly 25 coupled to the front edge of the cylinder 21 and having an a suction valve and a discharge valve, a suction muffler 26 coupled to the suction side of the valve assembly 25, a discharge cover 27 coupled to accommodate the discharge side of the valve assembly 25, and a discharge muffler 28 communicating with the discharge cover 27 and attenuating discharge noise of refrigerants being discharged.

The operation of the hermetic compressor configured as above will now be described.

When power is applied to the stator 11, the rotor 12 rotates the crank shaft 41 by electromagnetic interaction between the rotor 11 and the stator 12. When the crank shaft 41 rotates, the connecting rod 23 coupled to the crank shaft pin part 41*c* of the crank shaft 41 with the sleeve 24 located therebetween pivots, and the piston 22 coupled to the connecting rod 23 linearly reciprocates in the compression space V1 of the cylinder 21, thus repeating a series of processes.

Meanwhile, when the rotor 12 rotates the crank shaft 41, the crank shaft 41 is rotated together with the oil feeder 42 and the bushing 43 such that oil filled in the hermetic container 1 is induced to the oil feeder 42 and flows up to the upper end H of the bushing 43 by the centrifugal force.

The oil having flowed up to the upper end H of the bushing 43 ascends up to the first oil hole 41*d* of the crank shaft 41 along the oil groove 41*a* by the viscous force. The oil having flowed into the first oil hole 41*d* is discharged through the second oil hole 41*e*. In this case, a portion of the oil is supplied to the compression part 20 while the other portion thereof is supplied between the frame 30 and the crank shaft 41 to lubricate.

Figure 3:
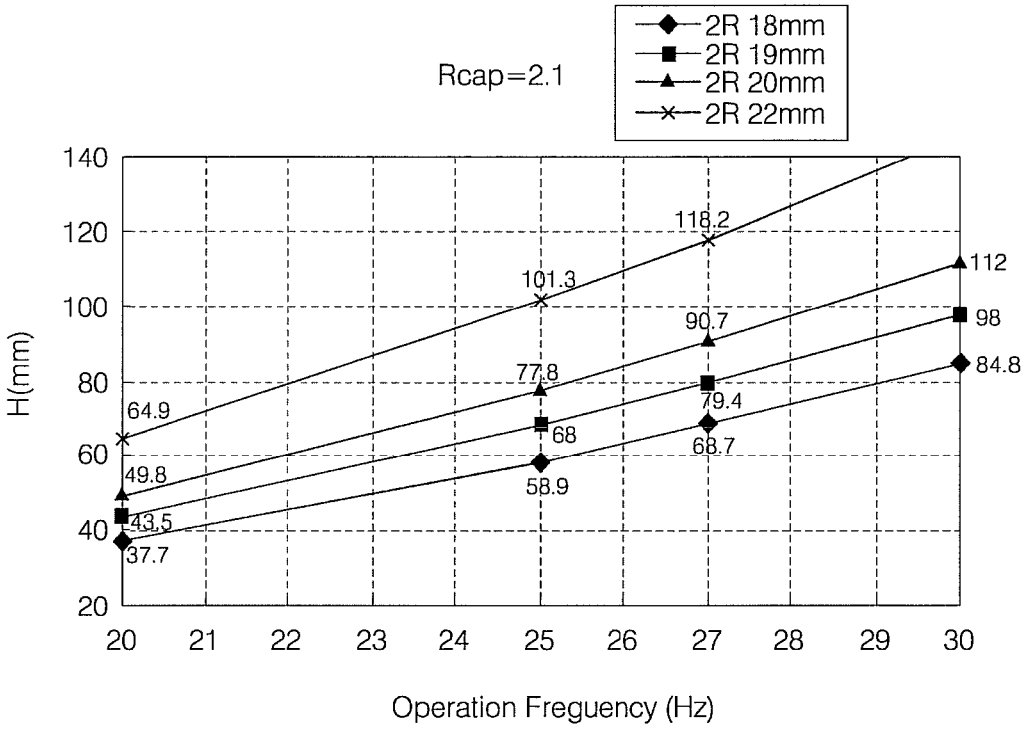
FIG. 3 is a graph showing an oil rise according to operation frequencies for each diameter of a crank shaft in a hermetic compressor according to an exemplary embodiment of the present invention.

FIG. 3 is a graph showing the rising height H of oil according to operation frequencies for each diameter 2R of the crank shaft 41 in a hermetic compressor according to an exemplary embodiment of the present invention.

Since the possible rising height of oil by the centrifugal force is associated with the shaft 2R of the crank shaft 41 and the operation frequency, which is a rotation speed of the crank shaft 41, the height H up to the upper end of the bushing 43 from the oil level is determined accordingly.

Referring to FIG. 3, as the operation frequency is lowered, the possible rising height of oil by the centrifugal force is also lowered. Thus, the height H up to the upper end of the bushing 43 needs to be lowered. Accordingly, in order to pump oil in the lower-speed operation in which the crank shaft 41 rotates slowly, the height H to the upper end of the bushing 43 needs to be low.

However, since the possible rising height of oil is increased as the diameter 2R, which is the diameter of oil at an operation frequency, is greater, the height H to the upper end of the bushing 43 can be increased. Accordingly, when the oil feeder 42 is coupled to surround the circumference of the crank shaft 41, the greater the diameter 2R of the crank shaft 41, the more stable oil supply becomes in the low-speed operation.

While the present invention has been shown and described in connection with the exemplary embodiments, it will be apparent to those skilled in the art that modifications and variations can be made without departing from the spirit and scope of the invention as defined by the appended claims.

Accordingly to the hermetic compressor according to the present invention, at least one of the following effects is obtained.

First, oil is pumped even in a low-speed operation, thus stably supplying oil.

Secondly, since the oil feeder is coupled to surround the circumference of the crank shaft, oil can be increased further by the centrifugal force.

Thirdly, when oil is pumped, the leakage of oil is prevented.

The effects of the present invention are not limited to the aforementioned ones, and other effects would also be clearly understood by those skilled in the art from claims.

What is claimed is:

1. A hermetic compressor, comprising:

a hermetic container filled with oil in a base thereof;

a rotatable crank shaft having a screw-shaped oil groove in an outer portion thereof;

an oil feeder having an upper portion in which a lower portion of the crank shaft is inserted, and a lower portion immersed in the oil in the hermetic container:

a frame through which the crank shaft passes to be rotatably coupled thereto;

a motor provided on a circumference of the crank shaft, that rotates the crank shaft, the motor including:

a stator supported on the frame; and a rotor provided at a lower side of the frame, fixedly coupled with the crank shaft, and rotated by electromagnetic interaction with the stator;

a bushing having an upper portion coupled between the frame and the crank shaft, and a lower portion coupled between the rotor and the crank shaft, wherein the crank shaft is rotated by the motor to pump oil along the oil groove, wherein no gap is provided between a lower surface of the bushing and the rotor, wherein a height gap is provided between an upper surface of the bushing and the frame, and wherein a radial gap is provided between a circumferential surface of the bushing and the frame.

2. The hermetic compressor of claim 1, wherein the bushing is press-fitted and coupled to the rotor.

3. The hermetic compressor of claim 1, wherein the bushing is rotatably coupled to the frame.

4. The hermetic compressor of claim 1, wherein the frame includes a lower portion bent such that the upper portion of the bushing is coupled thereto.

5. The hermetic compressor of claim 1, wherein the frame includes a lower portion slidingly coupled to the upper portion of the bushing so as to be rotatable.

6. The hermetic compressor of claim 1, wherein the rotor includes an upper portion bent such that the lower portion of the bushing is coupled thereto.

7. The hermetic compressor of claim 1, wherein the rotor includes an upper portion to which the lower portion of the bushing is press-fitted and thus fixedly coupled.

8. The hermetic compressor of claim 1, wherein the bushing is fixedly coupled to the circumference of the crank shaft.

9. The hermetic compressor of claim 1, wherein the bushing prevents oil leakage between the crank shaft and the frame.

10. The hermetic compressor of claim 1, wherein the crank shaft includes an eccentric crank shaft pin part formed at an upper portion of the crank shaft.

11. The hermetic compressor of claim 10, further comprising:

a connecting rod having a first end rotatably coupled to the crank shaft pin part of the crank shaft; and a piston rotatably coupled to a second end of the connecting rod relative to the crank shaft, that compresses a refrigerant while reciprocating.

12. The hermetic compressor of claim 10, wherein the crank shaft includes a first oil hole formed at an upper end of the oil groove, to which the oil is introduced, and the crank shaft pin part includes a second oil hole through which the oil introduced to the first oil hole is discharged.

13. The hermetic compressor of claim 1, wherein the height gap is in a range of 0.2 mm to 0.5 mm and the radial gap is in a range of 0.0 mm to 0.05 mm.

14. The hermetic compressor of claim 1, wherein a radial thickness of the bushing is in a range of 0.5 mm to 3.0 mm, and wherein a height of the upper portion of the bushing, which is rotatably coupled to the frame, is in a range of 1 mm to 10 mm.

15. A hermetic compressor, comprising:

a hermetic container filled with oil in a base thereof;

a rotatable crank shaft having a screw-shaped oil groove in an outer portion thereof;

an oil feeder provided at a lower portion of the crank shaft, that rotates when the crank shaft rotates such that the oil in the hermetic container flows upward by a centrifugal force;

a frame through which the crank shaft passes, the frame ascending the oil by a viscous force by not rotating when the crank shaft rotates;

a bushing fixedly coupled to a circumference of the crank shaft, the bushing having an upper portion rotatably coupled to a lower portion of the frame such that the oil flows upward by a centrifugal force; and a motor provided on the circumference of the crank shaft, that rotates the crank shaft, the motor including:

a stator supported on the frame; and a rotor rotated by electromagnetic interaction with the stator, provided at a lower side of the frame, and fixedly coupled to the crank shaft such that the oil flows upward by the centrifugal force, wherein no gap is provided between a lower surface of the bushing and the rotor, wherein a height gap is provided between an upper surface of the bushing and the frame, and wherein a radial gap is provided between a circumferential surface of the bushing and the frame.

16. The hermetic compressor of claim 15, wherein the height gap is in a range of 0.2 mm to 0.5 mm and the radial gap is in a range of 0.0 to 0.05 mm.

17. The hermetic compressor of claim 15, wherein a radial thickness of the bushing is in a range of 0.5 mm to 3.0 mm, and wherein a height of the upper portion of the bushing, which is rotatably coupled to the lower portion of the frame, is in a range of 1 mm to 10 mm.

* * * * *